United States Patent [19]

Schlick et al.

[11] Patent Number: 4,508,458

[45] Date of Patent: Apr. 2, 1985

[54] ELECTRIC CLOCK MOVEMENT, PARTICULARLY A QUARTZ CLOCK MOVEMENT

[75] Inventors: Horst Schlick, Schwalbach; Paul Höfert, Frankfurt am Main; Rudolf Caramel, Hofheim-Diedenbergen, all of Fed. Rep. of Germany

[73] Assignee: VDO Adolf Schindling AG, Frankfurt am Main, Fed. Rep. of Germany

[21] Appl. No.: 459,869

[22] Filed: Jan. 21, 1983

[30] Foreign Application Priority Data

Mar. 3, 1982 [DE] Fed. Rep. of Germany ..... 3207616

[51] Int. Cl.[3] ..... G04B 19/00

[52] U.S. Cl. ..... 368/76; 368/88; 368/157; 368/204; 361/331; 361/416

[58] Field of Search ..... 368/76, 88, 155, 156, 368/157, 160, 161, 203, 204; 361/331, 380, 420, 416

[56] References Cited

U.S. PATENT DOCUMENTS

| | | | |
|---|---|---|---|
| 1,803,310 | 5/1931 | Basseches | 361/420 |
| 2,986,675 | 5/1961 | Burson et al. | 361/380 |
| 2,990,500 | 6/1961 | Mierendorf | 361/420 |
| 3,159,769 | 12/1964 | Parrish | 361/331 |
| 3,461,663 | 8/1969 | Albinger, Jr. et al. | 368/309 |
| 3,535,595 | 10/1970 | Moore | 361/416 |
| 3,539,873 | 11/1970 | Rosenberg et al. | 361/416 |

FOREIGN PATENT DOCUMENTS

| | | | |
|---|---|---|---|
| 462281 | 1/1950 | Canada | 361/331 |
| 1218609 | 12/1957 | France | 361/331 |
| 1297292 | 5/1962 | France | 361/331 |

*Primary Examiner*—Bernard Roskoski
*Attorney, Agent, or Firm*—Martin A. Farber

[57] ABSTRACT

In an electric clock movement, the electronic components, such as an IC chip (9), a quartz crystal (10) or a diode (12), instead of being fastened to a circuit board are fastened to an extension (8) on the back plate (2). For this purpose, the extension (8) is provided with holes (14) into which the leads (15) of the electronic components are inserted.

4 Claims, 2 Drawing Figures

ELECTRIC CLOCK MOVEMENT, PARTICULARLY A QUARTZ CLOCK MOVEMENT

The present invention refers to an electric clock movement, particularly a quartz clock movement, having a gear train which is driven by an electric motor and arranged between two plates, at least one of which consists of plastic, as well as an electric circuit containing electronic components for the time-dependent driving of the motor.

Clock movements of this type are already known in which the electronic components such as a quartz crystal, a binary divider, capacitors, resistors, diodes and transistors which together form the drive circuit for the motor are arranged on a circuit board. The components are soldered to the conductive paths on the circuit board. The circuit board is attached to rear projections on the back plate by means of self-tapping screws. Such a construction has the disadvantage that it requires a considerable expenditure for assembly and results in a relatively large size for the entire clock movement. Clock movements of this type are used in wall clocks and, in particular, also in automobiles.

This disadvantage of the known clock movements is to be overcome by the present invention. The object of the invention, therefore, is to create an electric clock movement which can be produced as economically as possible and has a smaller volume than the known clock movements.

Starting from an electric clock movement of the type described above, this object is achieved in accordance with the invention in the manner that an extension (8) is developed on the plastic plate (2) and that the electronic components have their leads (15) connected directly to each other, so as to form the electric circuit, and to the extension (8).

This idea, which in itself is very simple, constitutes a break with the conventional principles of electronic design. One of the two plates which are in any event present in order to hold the mechanical parts of the clock movement is used in accordance with the invention also to hold the electronic components. In this way the expense of a circuit board, which was heretofore always necessary, is eliminated. Furthermore, the cost of assembly is reduced since the attachment of a circuit board to the back plate of the clock movement frequently afforded considerable difficulties and resulted in considerable structural expense. Finally, by a suitable arrangement of the extension and the arranging of the individual components on it, a reduction of the structural size and, in particular, of the thickness of the clock movement as compared with the known clock movements can be obtained.

In accordance with a preferred embodiment of the invention, holes (14) are provided in the extension (8) for fastening the components to the extension and for their electrical connection with each other, the leads (15) being inserted into said holes. In this way a wiring of the components suspended in space can be dispensed with, which is of particular importance when the clock movement is intended to be installed in automotive vehicles and wherein a wiring which is as insensitive to vibration as possible is important.

It has been found advantageous to make the diameter of each hole (14) of such size that the leads (15) which are brought together within a given hole (14) are held with a clamped fit therein. In this way, on the one hand, good electrical connection is obtained between the corresponding leads without any special additional expense while, on the other hand, assembly is facilitated, resulting in a substantial decrease in the cost of manufacture. However, if the clock movement is subject to extensive vibration or shaking it is advisable for the leads which are brought together within a hole (14) to be soldered together.

A particularly advantageous embodiment of the invention can be obtained if a part of the electrical circuit is combined in an IC chip (9) and the configuration of the holes (14) corresponds to the configuration of the leads (15) of the IC chip (9). In the case of a quartz clock movement, the oscillator without the quartz crystal, the frequency divider and a power output stage can be integrated in the IC chip so that, aside from the IC chip only the quartz crystal, one or two capacitors, a diode serving as protection against confusion of the poles and possibly a series resistor are present as components to be inserted into the holes.

With the above and other objects and advantages in view, the present invention will become more clearly understood in connection with the detailed description of a preferred embodiment, when considered with the accompanying drawings, of which:

Figure 1:
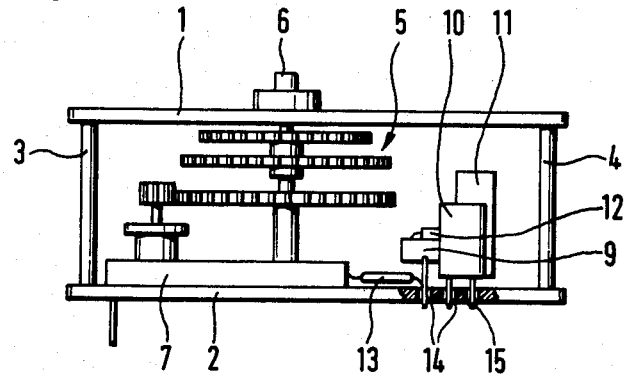
FIG. 1 is a side view of a clock movement in accordance with the invention.
Figure 2:
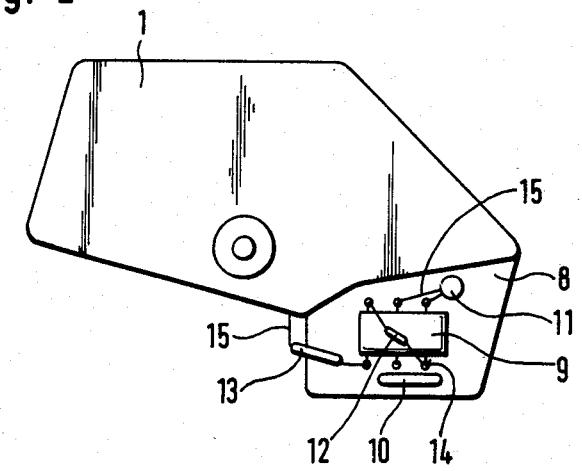
FIG. 2 is a plan view of the clock movement of FIG. 1.

The clock movement shown in FIGS. 1 and 2 has two plates 1 and 2 which are made of electrically nonconductive plastic and held at a fixed distance from each other by spacers 3 and 4. Between the plates 1 and 2 there is arranged a gear train 5 which drives a hands-socket 6 and a set arbor (not shown) arranged therein. For the driving of the gear train there is provided an electric motor 7, which may be a synchronous motor or a stepping motor.

On the back plate 2 there is formed an extension 8 on which the electronic components of the circuit—an IC chip 9, an encapsulated quartz crystal 10, a capacitor 11, a diode 12 and a series resistor 13—are seated. For this purpose holes 14 are provided in the extension 8 and the leads 15 of the components are inserted into these holes. Generally, in each hole 14 there are two or, at times, three or four connecting leads 15 which contact each other. The diameter of each hole 14 is such that the leads associated with the hole are held clamped firmly therein. In order to prevent unintentional loosening of the components the leads inserted into the same hole can be soldered together on the rear of the extension 8.

Holes are provided to receive the connecting elements.

We claim:

1. In an electric clock movement, particularly a quartz clock movement, having a gear train which is driven by an electric motor and arranged bertween two plates, at least one of which consists of plastic, as well as an electric circuit containing electronic components for the time-dependent driving of the motor, the improvement comprising an extension developed on only one of the plastic plates extending beyond the other plate, and wherein said electronic components have their connection leads connected directly to each other, so as to form the electric circuit, and connected to said extension wherein;

said extension is formed with an array of holes located for receiving the connection leads, the leads being inserted into said holes for their connection to each other and connection with said extension; and wherein the diameter of each said holes is of such a size that said connection leads which are brought together within a given said hole are held with a clamped fit therein, said holes constituting sole means for supporting and connecting said electrical components without any additional mechanical and electrical connecting and supporting means.

2. The electric clock movement according to claim 1, wherein a part of said electrical circuit is combined in an IC chip and the configuration of said holes corresponds to the configuration of the connection leads of the IC chip.

3. In an electric clock movement, particularly a quartz clock movement, having a gear train which is driven by an electric motor and arranged between two plates, at least one of which consists of plastic, as well as an electric circuit containing electronic components for the time-dependent driving of the motor, at least one of the plates being adapted to be mounted on extensively vibrating objects particularly vehicles, the improvement comprising an extension developed on only one of the plastic plates extending beyond the other plate, and wherein said electronic components have their connection leads connected directly to each other, so as to form the electric circuit, and connected to said extension wherein;

said extension is formed with an array of holes extending completely through said extension from a front side to an opposite rear side and located for receiving the connection leads, the leads being inserted into said holes for their connection to each other and connection with said extension, said electronic components being located adjacent said front side, the motor being located on said front side of said one plate between said plates; and wherein the diameter of each said holes is of such a size that said connection leads which are brought together within a given said hole are held with a clamped fit therein, said connection leads which are brought together within a hole are soldered together by solder on the rear side of the extension, and wherein said holes consituting sole means for supporting and connecting said electrical components without any additional mechanical and electrical connecting and supporting means other than said solder.

4. In an electric clock having a mechanical drive for positioning the clock hands and an electric circuit for energizing a motor of the drive, the clock comprising:

plate means including plates for supporting elements of said mechanical drive and having an extension on only one plate extending beyond the other of said plates, said one plate being non-electrically conducting, and wherein said electric circuit includes a set of modular components having leads for the conduction of electric signals among the components, said one plate having a set of holes of predetermined diameter arranged in an array in said extension for receiving groups of said leads, the diameters of respective ones of said holes being selected in accordance with the number of leads in each of said groups to provide for a tight gripping of each group of leads by said one plate, said one plate supporting said circuit components and maintaining electrical conductivity via their respective leads for the energizing of said motor, said holes constituting sole means for supporting and connecting said electrical components without any additional mechanical and electrical connecting and supporting means.

* * * * *